United States Patent [19]

Janich

[11] Patent Number: 4,515,686

[45] Date of Patent: May 7, 1985

[54] METHOD FOR THE OPERATION OF AN AIR SEPARATOR, AND AN AIR SEPARATOR FOR THE PRACTICE OF THE METHOD

[75] Inventor: Hans-Jürgen Janich, Neubeckum, Fed. Rep. of Germany

[73] Assignee: PKS-Engineering GmbH & Co. KG, Neubeckum, Fed. Rep. of Germany

[21] Appl. No.: 504,652

[22] Filed: Jun. 15, 1983

[30] Foreign Application Priority Data

Jun. 18, 1982 [DE] Fed. Rep. of Germany ..... 3222878

[51] Int. Cl.[3] ..... B07B 7/10

[52] U.S. Cl. ..... 209/139 A; 209/148; 209/154

[58] Field of Search ..... 209/139 A, 148, 154

[56] References Cited

U.S. PATENT DOCUMENTS

| | | | |
|---|---|---|---|
| 877,577 | 1/1908 | Emerick | 209/139 A |
| 2,062,064 | 11/1936 | Knox, Jr. et al. | 209/139 A |
| 2,741,366 | 4/1956 | Lykken | 209/139 A |
| 3,807,552 | 4/1974 | Gotthard | 209/139 A |

*Primary Examiner*—Tim Miles

*Attorney, Agent, or Firm*—Felfe & Lynch

[57] ABSTRACT

An air separator method and apparatus provides a second, preferably downward air stream about and rotating in the same sense as a first, upward air stream to carry away coarser feedstock material siezed from a supply and centrifugally separated from finer feedstock material by the first air stream.

21 Claims, 4 Drawing Figures

Figure 1:
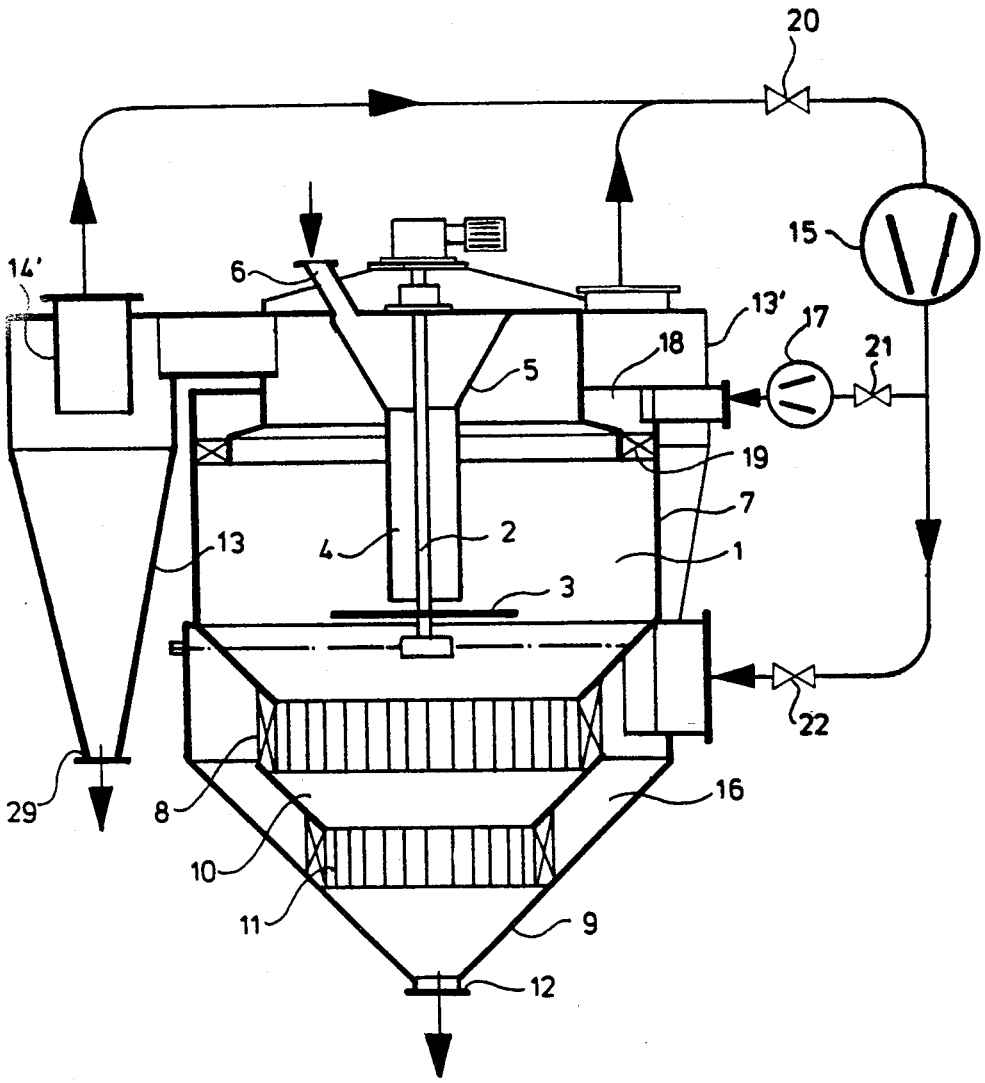

METHOD FOR THE OPERATION OF AN AIR SEPARATOR, AND AN AIR SEPARATOR FOR THE PRACTICE OF THE METHOD

The invention relates to a method for the operation of an air separator, preferably a circulating air separator equipped with a separating chamber which terminates at its bottom in a coarse material collector provided with a discharge spout, and in which the ungraded material is evenly distributed and is entrained by a rotary ascending air flow passing through the separating chamber from bottom to top which also moves the ungraded material towards the periphery of the separating chamber and removes the fines from the separating chamber with a discharge air stream, and it relates to an air separator for the application of the method.

DE-OS No. 2,414,767 discloses circulating air separators in which the material to be separated is dispersed in an upwardly-moving air stream and is separated by the action of the mass and drag forces of the flow into coarse and fine particles. The mass force can be gravitational force or centrifugal force produced by rotating the flow. In order to shift the boundary of separation, the separating air stream can be throttled in these circulating air separators by shutters or throttling valves. This method, however, is of limited effectiveness and results in a change in the output by weight, i.e., if, for example, the separating air stream is throttled less fine material is put out on account of the lessened carrying capacity of the air stream.

It is furthermore known, in the above-named circulating air separators, to dispose counterfans driven separately from the fan producing the separating air streams at variable speeds. The desired variation of the boundary of separation is in this case achieved by varying the speed of the counterfans. An increase of the speed results in a finer finished product and a reduction in a coarser one. This method does permit varying the boundary of separation over a wide range, but at the same time it greatly affects the selectivity of separation, the output of the fines, and the load that can be carried by the separating air stream.

The selectivity is substantially lower at low counterfan speeds than at higher speeds. In experiments, it has been found that the weight output is diminished as the counterfan speed is increased. This is the consequence of the throttling, produced by increasing the counterfan speed, of the separating air stream, which limits its carrying capacity. To remedy this disadvantage, it would be necessary to increase the separating air stream and, for the same boundary of separation, the counterfan speed as well.

This, however, would result in an enormous increase of the power required by the entire installation and increased wear on the casing parts, the counterfan system, and the main fan.

It is therefore the object of the invention to devise a method for the operation of an air separator, in which the boundary of separation between the fine and coarse particles can be widely varied. The method should also make it possible to vary centrifugal forces acting on the ungraded material, without throttling the separating air stream. The practice of this method should furthermore require only minor modification of conventional circulating air separators.

These objects are preferably achieved in accordance with the invention in that, in the method for the operation of an air separator, a rotating upward feedstock material-seizing air stream or flow which carries away upwardly finer components of the feedstock material is opposed by a co-rotational downward flow thereabout, i.e. adjacent the periphery of a casing which carries upward-stream separated coarse feedstock material to the bottom of the casing. The principle of the invention, however, can be expressed in more general terms by saying that an additional flow, rotating in the same sense as the ascending, separating flow is added thereabout to seize the coarser components of the feedstock material centrifugally separated by the ascending flow and carry it away.

At the bottom of the separating chamber, the downward flow enters the air stream of the upward flow. This reinforces the upward flow through the ungraded material. The downward flow can furthermore affect the rotational speed of the upward flow.

The rotating downward flow can be produced in this method by passive or active air-guiding devices at the top of the separating chamber or casing. The separation boundary in the air separator can be displaced by controlling the initial velocity of the downward flow, to affect the rotational speed of the upward flow. Depending on how an air separator is constructed, the initial velocity of the rotating downward flow can be varied either by varying the circulatory speed or by adjusting active air-guiding devices. An increase of the initial velocity results in a displacement of the separation boundary toward the fine-grain zone and a reduction in a displacement toward the coarse-grain zone. To be able to control the upward flow effectively, the initial circumferential velocity component of the downward flow must be at least as great as that of the upward flow.

The air separator can also be operated as a circulating air separator. For this, provision is made in the method for obtaining at least part of at least one of the discharge air streams after it carries away feedstock material, dividing it, and returning it to the separator casing, the first division producing the upward flow and the second the downward flow. If this is done, the volume of the exiting air stream remains unchanged, resulting in a substantial improvement in the rate of production and enabling the resulting circulating air separator to accept a greater input.

Advantageously, the air-stream division serving for the downward flow can be temperature-controlled and/or humidified or dehumidified. For example, the coarse material entrained by the downward flow can be cooled on the way to the coarse material collector, or, in the case of an excessively high moisture content, it can be dried. The temperature control and humidification and dehumidification also apply, of course, to the fines discharged by the upward flow, since the downward flow passes into the upward flow.

Circulating air separators suitable for the practice of the method have passive or active air-guiding devices disposed peripherally in the circumferential area of the separating chamber and receiving an air stream through external openings in the separating chamber. They are orientated to produce from the air stream a rotating, upward air stream and an additional flow situated adjacent the casing periphery, rotating in the same sense as the upward stream and preferably flowing downward. The downward flow carries the coarse material with it.

Air is delivered through at least one passage, preferably an annular passage, to passive air-guiding devices disposed peripherally on the top of the separating chamber. Meta air-guiding devices disposed below the annular passage are advantageous.

A rotating fan wheel having an axial opening and turned on a vertical shaft can be used as an active air-guiding device. The axial opening of the fan wheel presents no resistance to the ascending air flow. The fan means disposed on the outer circumference of the impeller produces the rotating downward flow.

In further development, the circulating air separator can be provided with an axial drive for the fan wheel, whereby the scatter plate will be simultaneously driven. Furthermore, at least one centrifugal separator is provided, to which the entire disharge air stream is delivered.

Figure 3:
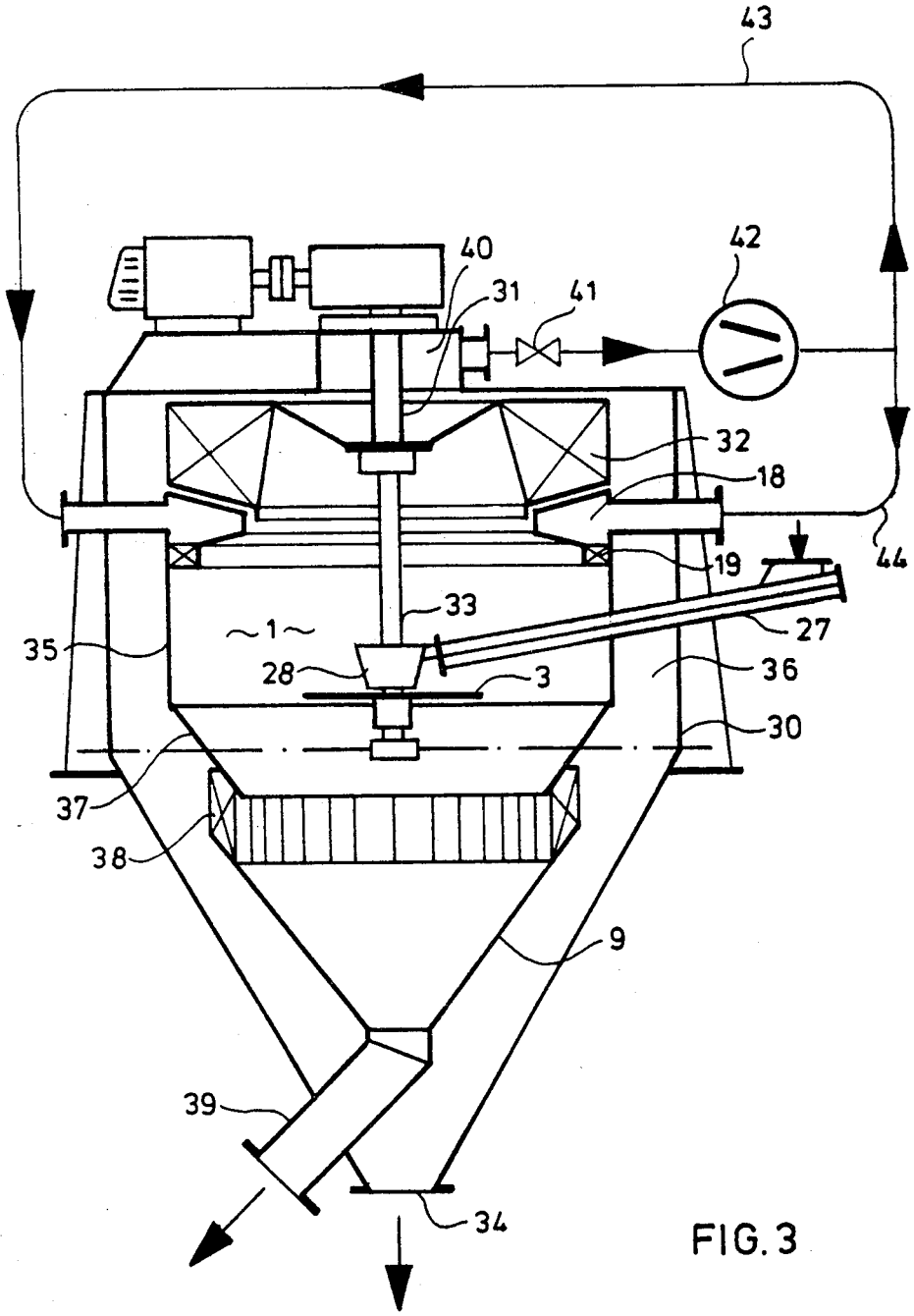

In the circulating air separators, furthermore, the divided air feed can be accomplished by means of a booster blower designed for a variable output volume (see FIG. 1 and FIG. 3). However, the air feed can also be regulated solely by means of a valve disposed in the divided-air duct. Advantageously, both possibilities for the control of the air stream will be provided. In the embodiment represented in FIG. 4, the divided air feed is delivered through an aperture the size of which can be adjusted by a sliding ring.

It is into the divided-air duct, furthermore, that the devices for heating and cooling and/or humidification and dehumidification of the descending air stream will be inserted, so that, after appropriate preliminary treatment, the downward stream will enter the separating chamber and act on the material being graded.

Examples of embodiments of the invention are represented in the drawings which will be further described hereinbelow and in which:

FIGS. 1, 2, 3 and 4 represent, respectively and schematically first, second, third and fourth embodiments of a circulating air separator in accordance with the invention.

In the circulating air separator represented in FIG. 1, an externally driven vertical shaft 2 on which a scatter plate 3 fed with material to be separated is fastened extends into a separating chamber 1. The shaft 2 is journaled in the bottom part of the separating chamber. It is surrounded by a material feed tube 4 which terminates at a distance above the scatter plate. The feed tube is connected to a material supply hopper 5 which is fed from an inlet spout 6.

The casing 7 enveloping the separating chamber 2 has a bottom part of conical construction which terminates at the bottom in a peripherally disposed air vane crown 8, and which extends into a coarse material collector 9. The air vane crown 8 is adjoined at the bottom, within the funnel-shaped portion of the coarse material collector, by an inner funnel 10 having a second crown 11 of air vanes. The funnel-shaped portion of the coarse material collector 9 terminates in the coarse material outlet spout 12.

On the circumference of the circulating air separator there are disposed centrifugal separators 13 and 13' for separating the fines; these separators are in air-flow communication with the upper part of the separating chamber 1 and their plunge tubes 14 are connected to the suction side of a fan 15 which is disposed outside of the separator casing and produces a circulating air current. The discharge side of the fan 15 is connected by a duct to a chamber 16 surrounding the air vane crowns 8 and 11. A branch of the duct, which is also equipped with a booster blower 17, leads into an annular passage 18 at the top of the separating chamber 1. The annular passage 18 is connected through air guiding baffles 19 on its bottom to the separating chamber 1. The air baffles 19 lie on the inside wall of the casing periphery 7 and are disposed such that an air stream entering the annular passage is converted by them into an downward flow rotating in the peripheral zone of the casing.

The air flowing in from the centrifugal separators 13 and 13' to the intake side of the fan 15 can be regulated by a valve 20. Furthermore, in the branch ducts on the discharge side of the fan 15 there are disposed valves 21 and 22 by which the volumes of the upward and downward flows can be adjusted independently of one another. The booster blower 17 in the branch duct carrying the downward flow is not absolutely necessary; the control of the air stream can also be performed by the valve 21. With respect to the total circulating air flow, the percentage of the downward flow that is fed by the booster blower 17 to the annular passage 18 can amount to between 0 and 50%. Normally, the percentage will be 25 to 30%.

The circulating air separator represented in FIG. 1 operates as follows:

The fan 15 of the circulating air separator produces a separating air stream of which a portion flows through the air vane crown system 8 and 11 into the separating chamber and ascends, while rotating, in the separating chamber. The other portion is fed through a branch duct to the annular passage 18 from which it enters through metal air guiding vanes into the separating chamber 1 and flows downwardly through the separating chamber adjacent the periphery of the casing.

The material delivered onto the rotating scatter plate 3 through the material supply hopper 5 and the feed tube 4 is evenly distributed in the separating chamber. The rotating upward flow passes through the flung material, carries the fines with it, and delivers them to the centrifugal separators 13 and 13'. The coarser particles are carried into the downward flow, guided by the flow into the bottom part of the separating chamber, and there, before they are discharged, they are once again sifted by the air delivered by the air vane crowns 8 and 11. The coarse material leaves the coarse material collector through the outlet spout 12. The downward flow is superimposed in the bottom part of the separating chamber onto the upward flow, but the volume of the separating air stream remains unchanged even if the partial streams are divided differently.

Figure 2:
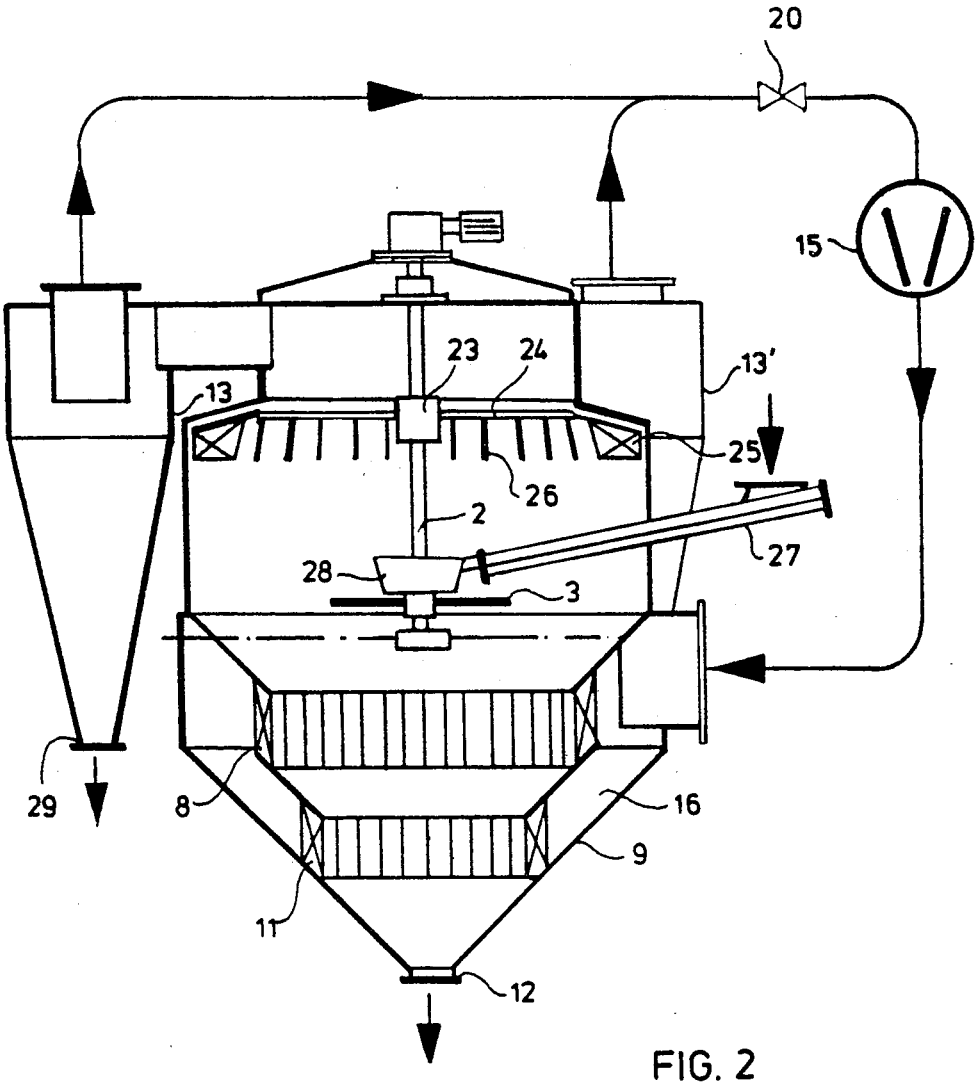

The embodiment in FIG. 2 shows a circulating air separator in which the fan 15 producing the circulating air stream is disposed outside of the separating chamber 1 and is connected on its intake side by ducts to the centrifugal separators 13 and 13', and on its discharge side by a duct to the chamber 16 surrounding the air vane crowns 8 and 11. The air stream flowing from the centrifugal separators 13 and 13' to the fan 15 can be regulated by a valve 20.

The circulating air separator has an externally driven vertical shaft 2 which is journaled in the lower part of the separating chamber. The shaft 2 is connected by a boss 23 and spokes 24 to an annular fan wheel 25 which is disposed preferably at the upper outside margin of the separating chamber. On the spokes 24 preferably vertical metal air guiding vanes 26 are disposed, which leave an axial opening for the upward flow from the separating chamber. The shaft 2 furthermore carries a scatter plate 3 to which ungraded material is fed through a conveyor trough 27 extending laterally into the separating chamber and having the trough spout 28. The trough spout 28 consists of a casing and guide blades disposed concentrically about the shaft 2. The rotatory speed of the shaft will be selected such that the fan wheel will produce a sufficient downward flow. The fan wheel 25, however, can also be driven independently of the drive of the scatter plate 3 by means of an outer hollow shaft (not shown). The circulating air separator otherwise is the same as the separator of FIG. 1. The same reference numbers have been selected for the same parts.

The manner of operation of the circulating air separator shown in FIG. 2 is as follows:

The circulating air stream produced by the fan 15 passes undivided through the system of air guiding vane crowns 8 and 11 into the separating chamber 1 and traverses it in the form of a rotating upward flow from bottom to top. On its course, the air stream entrains the fines contained in the ground material dispersed into the separating chamber by the scatter plate and carries it through the axial opening in the fan wheel 25 to the centrifugal separators 13 and 13' from which the separated fines exit downwardly through the opening 29.

A portion of the upward flow is taken by the annular fan 25 and driven downwardly as a rotating downward stream flowing adjacent the casing wall. Coarse material is carried by the air stream to the coarse material collector 9 and, after being twice sifted by separating air entering the separating chamber through the air guiding vane crowns 8 and 11, leaves it through the discharge spout 12.

The initial velocity of the downward air flow can be varied by changing the rotatory speed of the fan wheel 25. After the coarse material has been separated, the downward flow is superimposed in the bottom part of the separating chamber on the upward air stream, so that the latter remains constant in volume aside from slight friction losses.

The embodiment represented in FIG. 3 shows a recirculating air separator having an external casing 30, a hollow shaft 31 with fan 32 driven at constant speed by an external drive, and an internal shaft 33 carried through the hollow shaft 31 and journaled in the bottom part of the separating chamber, and bearing the scatter plate 3.

The external casing 30 merges at the bottom with a funnel-shaped portion having a spout 34 for the fines. An internal separating casing 35 is disposed coaxially with the external casing, so that a flow chamber 36 is formed between the internal and external casings. The internal casing 35 contains the separating chamber 1. At the bottom it has a conical portion 37 extending into the coarse material collector 9. Underneath the conical portion 37 of the separator casing there is disposed a crown 38 of air guiding vanes which is joined to the upper margin of the coarse material collector 9. The discharge spout 39 of the coarse material collector 9 is carried out through the wall of the external casing.

Above the separating chamber 1 the fan 32 is disposed, which is co-rotational with the hollow shaft 31. The hollow shaft 31 has a separate, controllable drive independent from the drive of the scatter plate 3. The supply of ground material to the scatter plate 3 is delivered by the conveyor chute 27 carried through the external and internal casings and having the delivery spout 28. The cover of the external casing 30 is extended in the center to an exit chamber 40 which is in communication with the chamber 36. A duct provided with a valve 41 leads laterally from the exit chamber 40 to the intake side of a booster blower 42. Between the exit chamber 40 and the blower 42 there can also be provided a centrifugal air separator (not shown) which further reduces the dust content of the air to save wear on the blower. The discharge side of the blower 42 is connected by branch ducts 43 and 44, carried laterally through the casing walls, to an annular passage 18. The annular passage 18 is preferably disposed in the peripheral area at the top of the separating chamber 1 and has metal air guiding vanes 19.

In the circulating air separator represented in FIG. 3, the ground material is fed through the conveyor chute 27 to the scatter plate 3 which uniformly scatters it into the separating chamber 1. The separating air drawn in by the fan 32 traverses the dispersed ground material, takes the fines with it, and delivers them to the flow chamber 36. In the flow chamber 36 the fines are separated and leave the separator through the spout 34.

While a large part of the separating air stream returns again to the separating chamber 1 through the air guiding crown 38 and resifts the coarse material, a largely dust-free air stream is aspirated by the booster blower 42 through the central exit chamber 40. The booster blower 42, which is designed for a variable delivery volume, drives this air through the branch ducts 43 and 44 to the annular passage 18. From the annular chamber 18 the air enters the separating chamber 1 through the air guiding vanes 19. The air stream set in rotation by the air guiding vanes 19 flows downwardly in the peripheral area of the internal casing 35, counter to the separating air stream. On its way the downward air stream carries coarse material with it. The coarse material is dropped in the collecting hopper 9 and from there it is carried out of the separator through the discharge spout 39. The downward air stream is superimposed in the bottom part of the separating chamber on the upward air stream, so that the separating air stream remains unchanged in volume.

The initial velocity of the partial air stream in the annular passage 18 can be regulated by the blower 42. The valve 41 regulates the ratio of the volumes of the upward and downward flows. The booster blower 42 is not absolutely necessary, since the air streams can be adjusted by means of the valve 41 alone.

Figure 4:
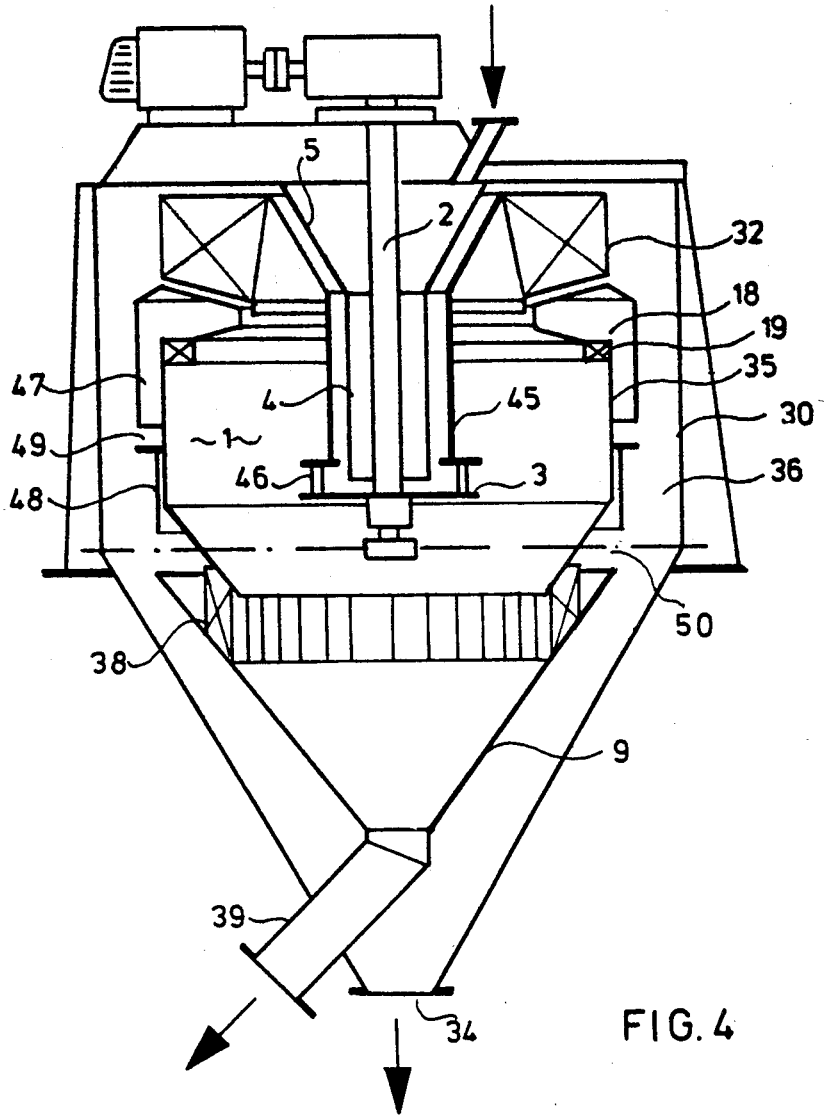

The fourth embodiment represented in FIG. 4 is composed, like the circulating air separator of FIG. 3, of an internal casing 35 and an external casing 30. The internal casing 35 encloses a separating chamber 1 into which a material supply hopper 5 and a feed tube 4 extend. The latter surround an externally driven shaft 2 which is journaled in the bottom part of the separating chamber. The feed tube 4 terminates at a distance above the scatter plate 3 which is co-rotational with the shaft 2. A hollow shaft 45 is disposed concentric with and at a distance from the supply hopper 5 and the feed tube 4, and is held at its bottom end by spacers 46 at a distance from the scatter plate 3. The upper end of the hollow shaft 45 bears a fan 32.

At the upper end of the separating chamber, an annular passage 18 is disposed in the peripheral area of the internal casing 35. In the bottom of the annular passage, where it opens onto the separating chamber, there are disposed the metal air guiding vanes 19. Air enters the annular passage 18 through an annular air duct 47 coaxial with the separator casing and communicating with the flow chamber 36 formed between the internal and external casings. Beneath the annular air duct 47 there is disposed an annular slide 48 whose level is adjustable.

The annular slide 48 leaves an annular opening 49 free between its upper end and the annular air duct 47, and leaves an annular gap 50 free between its bottom end and a projection at the separating air inlet. By means of the annular slide 48, the size of the annular opening 49 and of the annular gap 50 can be varied in inverse proportion to one another.

The parts corresponding to the circulating air separator of FIG. 3 have been provided with the same reference numbers so that their description applies also to this embodiment.

In the circulating air separator represented in FIG. 4, the circulating air stream produced by the fan 32 and emerging into the flow chamber 36 is divided and returned to the separating chamber 1. A portion of the air stream passes through the air guiding vane ring 38 into the bottom part of the separating chamber, where the coarse material being delivered against it is resifted before it reaches the collector 9. The air stream is aspirated by the fan and discharges the fines picked up in the separating chamber into the flow chamber 36.

The other part of the air stream passes through the opening 49 and the annular duct 47 into the annular passage 18. It leaves the annular passage 18 at its open bottom provided with air guide vanes 19 as a revolving downward flow carrying the coarse material out of the separating chamber. The ratio of the volumes of upward flow and downward flow can be adjusted by means of the annular slide 48, but the velocity of the circulating air stream is determined by the rotatory speed of the fan 32.

Apparatus, such as heat exchangers, absorbers, etc., (not shown), are provided in the circulating air separators represented in the figures, for heating or cooling, or humidifying or dehumidifying the downward air stream. In the case of the circulating air separators having external partial air stream ducting (FIGS. 1 and 3), these apparatus will be disposed in the ducting so that they will not greatly interfere with the flow. In the case of the separator in FIG. 2, the periphery of the separating chamber can be in the form of a double jacket carrying cooling or heating water in its interior. Short ribs can also be placed on this jacket facing the separating chamber to improve the heat exchange. In the case of the separator shown in FIG. 4, the heating or cooling apparatus are preferably disposed in the annular duct leading to the separating chamber.

In the method of the invention, which can be practiced in the circulating air separators described above, an upward air stream ascending and rotating in the separating chamber is countered by a downward air stream rotating in the same sense in the peripheral zone, preferably from the upper external margin of the separator casing. This downward flow can also, of course, begin from any other point on the wall of the separating chamber. The inwardly directed drag forces outweigh the outwardly directed centrifugal forces. Consequently, the coarse particles collect not on the wall of the separating chamber but mostly at the boundary between the upward flow and the downward flow, and are carried into the lower part of the separating chamber by the downward flow without constant contact with the wall. There, before they are separated, they are once again sifted by the upward air flow entering through an air guiding vane system. The downward flow superimposes itself at the bottom of the separating chamber on the upward air stream which imposes on it a certain rotatory speed. The upward stream carries with it the fines of the material being separated and on the basis of the predominating drag forces carries it to the fines separators.

The boundary separating the fines and coarse materials can be shifted in this method by varying the velocity of the downward air stream, since the downward flow affects the centrifugal forces acting on the ungraded material.

In the method, the volume of the separating air stream remains preferably unchanged. The division of the separating air stream into the partial air streams is accomplished by means of valves in the partial air stream ducts or by means of an annular slide or a ring fan. The air stream of the downward flow is delivered through passive or active air guiding means to the separating chamber. The initial velocity of the downward air flow can be influenced by means of an additional booster blower in the branch ductwork.

I claim:

1. Method for the operation of an air separator, prefereably a circulating air separator, which is equipped with a separating chamber terminating at its bottom in a coarse material collector provided with a discharge spout into which collector the feedstock is delivered in dispersed form and is seized by an upward stream flowing through the separating chamber rotatingly from bottom to top, the coarse material being moved towards the separating chamber casing periphery and the fines being removed from the separating chamber by a removal air stream, characterized in that to the upward air stream a flow rotating in the same sense is delivered adjacent the casing periphery (7) and seizes and carries away the coarse material.

2. In a method of operating an air separator having feedstock material therein, and a first, rotating, upward, feedstock material-seizing air stream for centrifugally separating outwardiy of the rotation of the first air stream coarser components of the feedstock material and carrying away upwardly finer components of the feedstock material, the improvement comprising:

providing a second air stream about the first air stream and rotating in the same sense as the first air stream at least for carrying away the centrifugally-separated coarser components of the feedstock material.

3. The method of claim 2, and further comprising also flowing the second air stream downwardly.

4. The method of claim 3, wherein the air separator has a separating chamber with the air streams therein and further comprising discharging at least a portion of the second air stream and, therewith, the coarser components of the feedstock material from the bottom thereof.

5. The method of claim 3, and additionally comprising entering at least part of the second, downwardly-flowing air stream into the first, upward air stream before the latter siezes the feedstock material.

6. The method of claim 2, and further comprising controllably varing at least the intial velocity of the second air stream.

7. The method of claim 3, and further comprising controllably varying at least the intial velocity of the second air stream.

8. The method of claim 4, and further comrpising controllably varying at least the intial velocity of the second air stream.

9. The method of claim 2, and further comprising providing the second air stream with an intial velocity having a circumferential component at least as great as that of the first air stream.

10. The method of claim 3, and further comprising providing the second air stream with an intial velocity having a circumferential component at least as great as that of the first air stream.

11. The method of claim 4, and further comprising providing the second air stream with an intial velocity having a circumferential component at least as great as that of the first air stream.

12. The method of claim 5, and further comprising providing the second air stream with an intial velocity having a circumferential component at least as great as that of the first air stream.

13. The method of claim 6, and further comprising providing the second air stream with an intial velocity having a circumferential component at least as great as that of the first air stream.

14. The method of claim 2, and further comprising at least one of heating, cooling, humidifying, and dehumidifying the second air stream.

15. The method of claim 3, and further comprising at least one of heating, cooling, humidifying, and dehumidifying the second air stream.

16. The method of claim 4, and further comprising at least one of heating, cooling, humidifying, and dehumidifying the second air stream.

17. The method of claim 3, and further comprising: obtaining at least part of at least one of the air streams. dividing it, and returning the divisions to the air separator as at least part of the respective air streams, whereby to form a circulating air separator.

18. In an air separator having a separating chamber and feedstock means for supplying feedstock material to the separating chamber, the improvement comprising, in combination:

first means for providing a first, rotating, upward air stream in the separating chamber for seizing the feedstock material supplied by the feedstock means, rotating the same for centrifugally separating outwardly of the rotation of the first air stream coarser components of the feedstock material, and carrying away upwardly finer components of the feedstock material; and second means providing a second air stream about the first air stream and rotating in the same sense as the first air stream at least for carrying away the centrifugally-separated coarser components of the feedstock material.

19. The air separator of claim 18 wherein the second means comprises at least one of passive air-guide devices at the periphery of the separating chamber and an active air-guide devices at the top of the separating chamber for providing the second air stream downwardly therein.

20. The air separator of claim 19, wherein the feedstock means comprises a rotating scatter plate and the second means comprises a fan, and further comprising an axial drive common to both thereof.

21. The air separator of claim 18 and further comprising means for controlling at least the initial velocity of at least the second air stream.

* * * * *